US009986767B2

(12) United States Patent
Batista et al.

(10) Patent No.: US 9,986,767 B2
(45) Date of Patent: Jun. 5, 2018

(54) AEROSOL-FORMING CARTRIDGE COMPRISING A LIQUID NICOTINE SOURCE

(71) Applicant: Philip Morris Products S.A., Neuchatel (CH)

(72) Inventors: Rui Nuno Batista, Morges (CH); Stephane Hedarchet, Pully (CH)

(73) Assignee: Philip Morris Products S.A., Neuchatel (CH)

( * ) Notice: Subject to any disclaimer, the term of this patent is extended or adjusted under 35 U.S.C. 154(b) by 0 days. days.

(21) Appl. No.: 15/325,279

(22) PCT Filed: Jul. 9, 2015

(86) PCT No.: PCT/EP2015/065767
§ 371 (c)(1),
(2) Date: Jan. 10, 2017

(87) PCT Pub. No.: WO2016/005530
PCT Pub. Date: Jan. 14, 2016

(65) Prior Publication Data

US 2017/0181472 A1 Jun. 29, 2017

(30) Foreign Application Priority Data

Jul. 11, 2014 (EP) ..... 14176828

(51) Int. Cl.
*A24F 47/00* (2006.01)
*H05B 1/02* (2006.01)

(52) U.S. Cl.
CPC ..... *A24F 47/008* (2013.01); *H05B 1/0244* (2013.01); *H05B 2203/021* (2013.01)

(58) Field of Classification Search
CPC ..... A24F 47/008
(Continued)

(56) References Cited

U.S. PATENT DOCUMENTS 3,320,953 A 5/1967 Rindner
5,095,921 A 3/1992 Losee et al.
(Continued)

FOREIGN PATENT DOCUMENTS

EP 1 736 065 A1 12/2006
WO WO 2007/024130 A1 3/2007
(Continued)

OTHER PUBLICATIONS

Extended European Search Report dated Jan. 8, 2015 in Patent Application No. 14 17 6828.
(Continued)

*Primary Examiner* — Phuong Dinh
(74) *Attorney, Agent, or Firm* — Oblon, McClelland, Maier & Neustadt, L.L.P.

(57) ABSTRACT

There is provided an aerosol-forming cartridge for an electrically operated aerosol-generating system. The cartridge includes a base layer, at least one aerosol-forming substrate disposed on the base layer and including a liquid nicotine source, and an electric heater including at least one heating element configured to heat the at least one aerosol-forming substrate. The base layer and the at least one aerosol-forming substrate are in contact at a contact surface that is substantially planar. The electric heater and one or both of the base layer and the at least one aerosol-forming substrate are in contact at a contact surface that is substantially planar and substantially parallel to the contact surface between the base layer and the at least one aerosol-forming substrate.

21 Claims, 5 Drawing Sheets

(58) Field of Classification Search
USPC ..... 131/173–330
See application file for complete search history.

(56) References Cited

U.S. PATENT DOCUMENTS

| | | | | |
|---|---|---|---|---|
| 5,322,075 | A | 6/1994 | Deevi et al. | |
| 2013/0298905 | A1 | 11/2013 | Levin et al. | |
| 2014/0060554 | A1 | 3/2014 | Collett et al. | |
| 2015/0027459 | A1 | 1/2015 | Collett et al. | |
| 2015/0053217 | A1* | 2/2015 | Steingraber | A24F 47/008 131/329 |
| 2015/0136154 | A1* | 5/2015 | Mitrev | A24F 47/008 131/328 |
| 2016/0324845 | A1* | 11/2016 | Myers | A61K 9/0004 |
| 2017/0020200 | A1* | 1/2017 | Robinson | A24F 47/008 |
| 2017/0136196 | A1* | 5/2017 | Davidson | A61M 15/0028 |

FOREIGN PATENT DOCUMENTS

| | | | |
|---|---|---|---|
| WO | WO 2007/066374 | A1 | 6/2007 |
| WO | WO 2007/131449 | A1 | 11/2007 |
| WO | WO 2007/131450 | A1 | 11/2007 |
| WO | 2014/021310 | A1 | 2/2014 |
| WO | 2014/104078 | A1 | 7/2014 |

OTHER PUBLICATIONS

International Search Report and Written Opinion dated Oct. 30, 2015, in PCT/EP2015/065767, filed Jul. 9, 2015.

* cited by examiner

AEROSOL-FORMING CARTRIDGE COMPRISING A LIQUID NICOTINE SOURCE

TECHNICAL FIELD

The present disclosure relates to an aerosol-forming cartridge for use in an electrically operated aerosol-generating system. In particular, the present invention relates to aerosol-forming cartridges having at least one aerosol-forming substrate comprising a liquid nicotine source. The present invention also relates to aerosol-generating systems comprising aerosol-forming cartridges and to methods of manufacturing aerosol-forming cartridges.

DESCRIPTION OF THE RELATED ART

One type of aerosol-generating system is an electrically operated smoking system. Handheld electrically operated smoking systems consisting of an electric vaporiser, an aerosol-generating device comprising a battery and control electronics, and an aerosol-forming cartridge are known. Typically, aerosol-forming cartridges for use with aerosol-generating devices comprise an aerosol-forming substrate that is assembled, often with other elements or components, in the form of a rod. Typically, such a rod is configured in shape and size to be inserted into an aerosol-generating device that comprises a heating element for heating the aerosol-forming substrate. Other known aerosol-forming cartridges comprise an aerosol-forming substrate in contact, or in close proximity with an electric heater forming part of the cartridge. In one such example, the cartridge comprises a supply of liquid aerosol-forming substrate and a coil of heater wire wound around an elongate wick soaked in the liquid aerosol-forming substrate. Known cartridges typically comprise a mouthpiece portion, which the user sucks on in use to draw aerosol into their mouth.

However, known aerosol-forming cartridges are relatively expensive to produce. This is because of their complexity and the fact that their manufacture typically requires extensive manual assembly operations. Further, these cartridges often require delicate handling, or the provision of a protective outer housing, in order to avoid damage during transport.

US-A-2013/298905 provides an electrically operated aerosol-generating system in the form of a tubular smoking article containing an electrical power source and a heating element for heating a substance to be vaporised. The device may have a grinding chamber for grinding up a solid substance to be vaporised, or a cavity for receiving a consumable cartridge loaded with the substance to be vaporised. The heating element is adjacent to the cartridge.

U.S. Pat. No. 3,320,953 provides an non-heated inhaler in the shape of a cigarette, cigar, or pipe. The inhaler includes a removable container containing a volatile material that is released during use.

WO-A1-2014/104078 provides a smoking article containing a non-combustible tobacco product flavour source. The flavour source comprises a flat, rectangular block of granular tobacco material and menthol held within a binder, which is sandwiched between flat upper and lower layers. The flavour source is disposed of along with the rest of smoking article when the flavour source has been consumed.

WO-A1-2014/021310 provides a non-heated flavour inhalation device formed from an inner pouch, containing a flavour-generating source, which is held within a deformable outer pouch. Both the inner and outer pouches are formed from non-woven fabric folded into an oval cylinder shape.

It would be desirable to provide an aerosol-forming cartridge that is robust and inexpensive to produce.

SUMMARY

According to a first aspect of the present invention, there is provided an aerosol-forming cartridge for use in an electrically operated aerosol-generating system, the cartridge comprising: a base layer; at least one aerosol-forming substrate arranged on the base layer and comprising a liquid nicotine source; and an electric heater including at least one heating element arranged to heat the at least one aerosol-forming substrate, wherein the base layer and the at least one aerosol-forming substrate are in contact at a contact surface which is substantially planar, and wherein a contact surface between the electric heater and one or both of the base layer and the at least one aerosol-forming substrate is substantially planar and substantially parallel to the contact surface between the base layer and the at least one aerosol-forming substrate.

By having the base layer and the at least one aerosol-forming substrate in contact at a contact surface which is substantially planar, and by having the electric heater and one or both of the base layer and the at least one aerosol-forming substrate in contact at a contact surface which is substantially planar and substantially parallel to the contact surface between the base layer and the at least one aerosol-forming substrate, the cartridge can be advantageously manufactured using only vertical assembly operations. This simplifies the manufacture of the cartridge by removing the need for any more complex assembly operations, such as rotational or multi-translational movements of the cartridge or its components, as known in the manufacture of cylindrical objects, such as cigarettes. Such cartridges can also be made using fewer components than conventional cartridges and are generally more robust.

As used herein, the term "cartridge" refers to a consumable article which is configured to couple to and uncouple from an aerosol-generating device to form an aerosol-generating system and which is assembled as a single unit that can be coupled and uncoupled from the aerosol-generating device by a user as one when the article has been consumed.

As used herein, the term "aerosol-forming cartridge" refers to a cartridge comprising an aerosol-forming substrate that is capable of releasing volatile compounds that can form an aerosol. For example, an aerosol-generating cartridge may be a smoking article.

As used herein, the term 'aerosol-forming substrate' is used to describe a substrate capable of releasing volatile compounds, which can form an aerosol. The aerosols generated from aerosol-forming substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

As used herein, the term "contact" includes direct contact between two components of the cartridge, as well as indirect contact via one or more intermediate components of the cartridge, such as coatings or laminated layers.

As used herein, the term "substantially planar", means arranged substantially along a single plane.

BRIEF DESCRIPTION OF THE DRAWINGS

Embodiments will now be further described, by way of example only, with reference to the accompanying drawings in which:

FIG. 2A is a perspective view and FIG. 2B is an exploded view of the cartridge;

FIG. 3A is a perspective view and FIG. 3B is an exploded view of the cartridge;

DETAILED DESCRIPTION

Figure 1A:
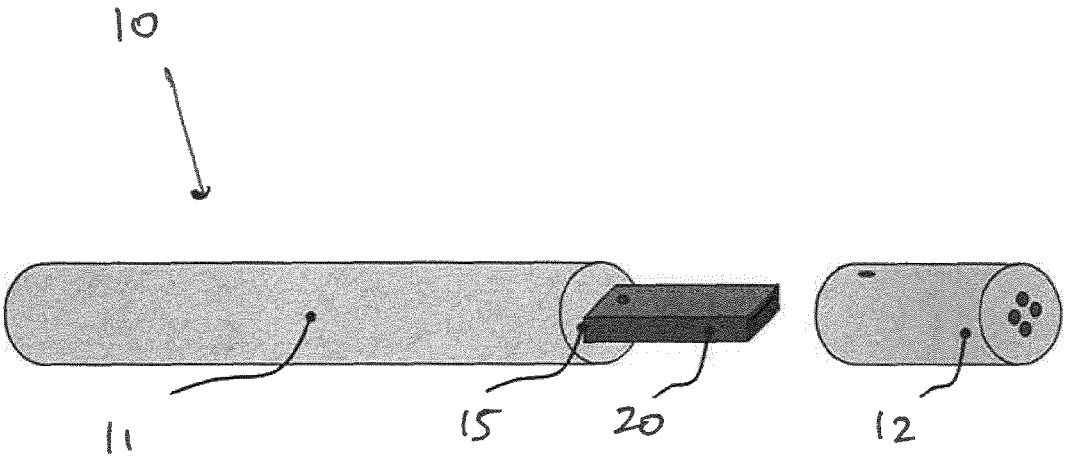
FIGS. 1A and 1B show a schematic illustration of an aerosol-generating system comprising an aerosol-forming cartridge in accordance with an embodiment of the present invention, inserted into an electrically operated aerosol-generating device.

Preferably the aerosol-forming cartridge is a heated smoking article, which is a smoking article comprising an aerosol-forming substrate that is intended to be heated rather than combusted in order to release volatile compounds that can form an aerosol.

The cartridge may have any suitable outer shape. The cartridge may be an elongate aerosol-forming cartridge having a downstream end, through which aerosol exits the aerosol-generating cartridge and is delivered to a user, and an opposed upstream end. In such embodiments, components, or portions of components, of the aerosol-forming substrate may be described as being upstream or downstream of one another based on their relative positions between the proximal or downstream end and the distal or upstream end. Preferably, the cartridge is substantially flat. In certain embodiments, the cartridge is substantially flat and has a rectangular cross-section.

The cartridge may have any suitable size. Preferably, the cartridge has suitable dimensions for use with a handheld aerosol-generating system. In certain embodiments, the cartridge has length of from about 5 mm to about 200 mm, preferably from about 10 mm to about 100 mm, more preferably from about 20 mm to about 35 mm. In certain embodiments, the cartridge has width of from about 5 mm to about 12 mm, preferably from about 7 mm to about 10 mm. In certain embodiments, the cartridge has a height of from about 2 mm to about 10 mm, preferably form about 5 mm to about 8 mm.

Preferably, the at least one aerosol-forming substrate is substantially flat. As used herein, the term "substantially flat" means having a thickness to width ratio of at least 1:2, preferably from 1:2 to about 1:20. This includes, but is not limited to having a substantially planar shape. Flat components can be easily handled during manufacture and provide for a robust construction. In addition, it has been found that aerosol release from the aerosol-forming substrate is improved when it is substantially flat and when a flow of air is drawn across the width, length, or both, of the aerosol-forming substrate.

In certain embodiments, one or both of the base layer and the at least one aerosol-forming substrate has a non-curved cross-section. This reduces the amount of rolling movement of these components during manufacture, improving assembly precision and ease of assembly. In certain embodiments, one or both of the base layer and the at least one aerosol-forming substrate is substantially planar.

The term "base layer" refers to a layer of the cartridge which supports the aerosol-forming substrate and not necessarily to the position of the layer within the cartridge. The base layer may be the lowermost layer of the cartridge, although it is not limited to this position.

The base layer may have any suitable cross-sectional shape. Preferably, the base layer has a non-circular cross-sectional shape. In certain preferred embodiments, the base layer has a substantially rectangular cross-sectional shape. In certain embodiments, the base layer has an elongate, substantially rectangular, parallelepiped shape. In certain preferred embodiments, the base layer is substantially flat.

The aerosol-forming substrate may be arranged directly on the base layer, or indirectly via one or more intermediate layers. The base layer may have a substantially planar top surface on which the aerosol-forming substrate is arranged. In preferred embodiments, the base layer comprises at least one cavity in which the at least one aerosol-forming substrate is held. This helps to maintain correct positioning of the aerosol-forming substrate within the cartridge and makes it easier to seal the aerosol-forming substrate within the cartridge, if required. In certain embodiments, the at least one aerosol-forming substrate comprises a plurality of aerosol-forming substrates arranged separately on the base layer and the base layer comprises a plurality of cavities. Two or more aerosol-forming substrates may then be held in different cavities. Where the aerosol-forming substrates have different compositions, storing them separately in separate cavities can prolong the life of the cartridge. Another advantage is that it also enables the cartridge to store two or more incompatible aerosol-forming substrate substances. In certain embodiments, one or more of the cavities are selectively openable from a closed position.

The base layer may be formed from a single component. Alternatively, the base layer may be formed from multiple layers or components. For example, the base layer may be formed from a first layer defining side walls of the at least one cavity and a second layer defining a bottom wall of the at least one cavity.

The base layer may be formed using any suitable manufacturing method. In certain embodiments, the base layer comprises a polymeric foil. Such a base layer may comprise one or more cavities formed from one or more blisters in the foil. The polymeric foil may comprise any suitable material, such as, but not limited to, one or more of a Polyimide (PI), a Polyaryletherketone (PAEK), such as Polyether Ether Ketone (PEEK), Poly Ether Ketone (PEK), or Polyetherketoneetherketoneketone (PEKEKK), or a Fluoric polymer, such as Polytetrafluoroethylene (PTFE), Polyvinylidene Fluoride (PVDF), Ethylene tetrafluoroethylene (ETFE), PVDFELS, or Fluorinated Ethylene Propylene (FEP). Alternatively, the base layer may be formed by injection moulding of a polymeric material, such as, but not limited to, one or more of a Polyaryletherketone (PAEK), such as Polyether Ether Ketone (PEEK), Poly Ether Ketone (PEK), or Polyetherketoneetherketoneketone (PEKEKK), a Polyphenylensulfide, such as Polypropylene (PP), Polyphenylene sulfide (PPS), or Polychlorotrifluoroethene (PCTFE or PTFCE), a Polyarylsulfone, such as Polysulfone (PSU), Polyphenylsulfone (PPSF or PPSU), Polyethersulfone (PES), or Polyethylenimine (PEI), or a Fluoric polymer, such as Polytetrafluoroethylene (PTFE), Polyvinylidene Fluoride (PVDF), Ethylene tetrafluoroethylene (ETFE), PVDFELS, or Fluorinated Ethylene Propylene (FEP).

The at least one aerosol-forming substrate comprises a liquid nicotine source. The cartridge may comprise one or more containers for retaining the liquid nicotine source on the base layer. In preferred embodiments, the at least one aerosol-forming substrate comprises one or more porous carrier materials into which the liquid nicotine source is absorbed, as described in WO-A-2007/024130, WO-A-2007/066374, EP-A-1 736 062, WO-A-2007/131449 and WO-A-2007/131450.

In a particularly preferred embodiment, the porous carrier material comprises a high retention material, such as one comprising one or more of Polyester, Polypropylene, or Polyethylene terephthalate (PET) fibres. Alternatively, or in addition, the porous carrier material may comprise one or more capillary wicks in tow or textile form, such as capillary wicks comprising one or more of glass fibres, PTFE, or High-density Polyethylene (HDPE).

Preferably, the liquid nicotine source comprises one or more of nicotine, nicotine base, a nicotine salt, such as nicotine-HCl, nicotine-bitartrate, or nicotine-ditartrate, or a nicotine derivative.

The nicotine source may comprise natural nicotine or synthetic nicotine.

The nicotine source may comprise pure nicotine, a solution of nicotine in an aqueous or non-aqueous solvent or a liquid tobacco extract.

The nicotine source may further comprise an electrolyte forming compound. The electrolyte forming compound may be selected from the group consisting of alkali metal hydroxides, alkali metal oxides, alkali metal salts, alkaline earth metal oxides, alkaline earth metal hydroxides and combinations thereof.

For example, the nicotine source may comprise an electrolyte forming compound selected from the group consisting of potassium hydroxide, sodium hydroxide, lithium oxide, barium oxide, potassium chloride, sodium chloride, sodium carbonate, sodium citrate, ammonium sulfate and combinations thereof.

In certain embodiments, the nicotine source may comprise an aqueous solution of nicotine, nicotine base, a nicotine salt or a nicotine derivative and an electrolyte forming compound.

Alternatively or in addition, the nicotine source may further comprise other components including, but not limited to, natural flavours, artificial flavours and antioxidants.

In addition to a nicotine source, the aerosol-forming substrate may further comprise a source of a volatile delivery enhancing compound that reacts with the nicotine in the gas phase to aid delivery of the nicotine to the user.

The volatile delivery enhancing compound may comprise a single compound. Alternatively, the volatile delivery enhancing compound may comprise two or more different compounds.

Preferably, the volatile delivery enhancing compound is a volatile liquid.

The volatile delivery enhancing compound may comprise an aqueous solution of one or more compounds. Alternatively the volatile delivery enhancing compound may comprise a non-aqueous solution of one or more compounds.

The volatile delivery enhancing compound may comprise two or more different volatile compounds. For example, the volatile delivery enhancing compound may comprise a mixture of two or more different volatile liquid compounds.

Alternatively, the volatile delivery enhancing compound may comprise one or more non-volatile compounds and one or more volatile compounds. For example, the volatile delivery enhancing compound may comprise a solution of one or more non-volatile compounds in a volatile solvent or a mixture of one or more non-volatile liquid compounds and one or more volatile liquid compounds.

In one embodiment, the volatile delivery enhancing compound comprises an acid. The volatile delivery enhancing compound may comprise an organic acid or an inorganic acid. Preferably, the volatile delivery enhancing compound comprises an organic acid, more preferably a carboxylic acid, most preferably an alpha-keto or 2-oxo acid.

In a preferred embodiment, the volatile delivery enhancing compound comprises an acid selected from the group consisting of 3-methyl-2-oxopentanoic acid, pyruvic acid, 2-oxopentanoic acid, 4-methyl-2-oxopentanoic acid, 3-methyl-2-oxobutanoic acid, 2-oxooctanoic acid and combinations thereof. In a particularly preferred embodiment, the volatile delivery enhancing compound comprises pyruvic acid.

Preferably, the at least one aerosol-forming substrate comprises an aerosol former, that is, a substance which generates an aerosol upon heating. The aerosol former may be, for instance, a polyol aerosol former or a non-polyol aerosol former. It may be a solid or liquid at room temperature, but preferably is a liquid at room temperature. Suitable polyols include sorbitol, glycerol, and glycols like propylene glycol or triethylene glycol. Suitable non-polyols include monohydric alcohols, such as menthol, high boiling point hydrocarbons, acids such as lactic acid, and esters such as diacetin, triacetin, triethyl citrate or isopropyl myristate. Aliphatic carboxylic acid esters such as methyl stearate, dimethyl dodecanedioate and dimethyl tetradecanedioate can also be used as aerosol formers. A combination of aerosol formers may be used, in equal or differing proportions. Polyethylene glycol and glycerol may be particularly preferred, whilst triacetin is more difficult to stabilise and may also need to be encapsulated in order to prevent its migration within the product. The at least one aerosol-forming substrate may include one or more flavouring agents, such as cocoa, liquorice, organic acids, or menthol.

The at least one aerosol-forming substrate may comprise a single aerosol-forming substrate. Alternatively, the at least one aerosol-forming substrate may comprise a plurality of aerosol-forming substrates. The plurality of aerosol-forming substrates may have substantially the same composition. Alternatively, the plurality of aerosol-forming substrates may comprise two or more aerosol-forming substrates having substantially different compositions. The plurality of aerosol-forming substrates may be stored together on the base layer. Alternatively, the plurality of aerosol-forming substrates may be stored separately. By separately storing two or more different portions of aerosol-forming substrate, it is possible to store two substances which are not entirely compatible in the same cartridge. Advantageously, separately storing two or more different portions of aerosol-forming substrate may extend the life of the cartridge. It also enables two incompatible substances to be stored in the same cartridge. Further, it enables the aerosol-forming substrates to be aerosolised separately, for example by heating each aerosol-forming substrate separately. Thus, aerosol-forming substrates with different heating profile requirements can be heated differently for improved aerosol formation. It may also enable more efficient energy use, since more volatile substances can be heated separately from less volatile substances and to a lesser degree. Separate aerosol-forming substrates can also be aerosolised in a predefined sequence, for example by heating a different one of the plurality of aerosol-forming substrates for each use, ensuring a 'fresh' aerosol-forming substrate is aerosolised each time the cartridge is used.

Preferably the at least one aerosol-forming substrate is substantially flat. The at least one aerosol-forming substrate may have any suitable cross-sectional shape. Preferably, the at least one aerosol-forming substrate has a non-circular cross-sectional shape. In certain preferred embodiments, the at least one aerosol-forming substrate has a substantially rectangular cross-sectional shape. In preferred embodiments, the aerosol-forming substrate has a substantially planar first surface which forms the contact surface between the aerosol-forming substrate and the base layer, and a substantially planar second surface, opposite to the first surface, from which aerosol is releasable upon heating. In certain embodiments, the at least one aerosol-forming substrate has an elongate, substantially rectangular, parallelepiped shape.

In certain preferred embodiments, the at least one aerosol-forming substrate has a vaporisation temperature of from about 70 degrees Celsius to about 230 degrees Celsius, preferably from about 90 degrees Celsius to about 180 degrees Celsius.

In any of the embodiments of the cartridge, the preferred material or materials for each of the various cartridge components will depend on the required vaporisation temperature of the aerosol-forming substrate.

In use, the at least one aerosol-forming substrate is vaporised by the electric heater. The electric heater may be substantially flat. In preferred embodiments, the electric heater is substantially planar.

The electric heater may be arranged to heat the aerosol-forming substrate by one or more of conduction, convection and radiation. The heater may heat the aerosol-forming substrate by means of conduction and may be at least partially in contact with the aerosol-forming substrate. Alternatively, or in addition, the heat from the heater may be conducted to the aerosol-forming substrate by means of an intermediate heat conductive element. Alternatively, or in addition, the heater may transfer heat to the incoming ambient air that is drawn through or past the cartridge during use, which in turn heats the aerosol-forming substrate by convection.

The heater is an electric heater powered by an electric power supply. The term "electric heater" refers to one or more electric heating elements. The electric heater may comprise an internal electric heating element for at least partially inserting into the aerosol-forming substrate. An "internal heating element" is one which is suitable for insertion into an aerosol-forming material. Alternatively or additionally, the electric heater may comprise an external heating element. The term "external heating element" refers to one that at least partially surrounds the aerosol-forming substrate. The electric heater may comprise one or more internal heating elements and one or more external heating elements. The electric heater may comprise a single heating element. Alternatively, the electric heater may comprise more than one heating element. In certain embodiments, the cartridge comprises an electric heater comprising one or more heating elements.

The electric heater may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium- titanium- zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required. Alternatively, the electric heater may comprise an infra-red heating element, a photonic source, or an inductive heating element.

The electric heater may take any suitable form. For example, the electric heater may take the form of a heating blade. Alternatively, the electric heater may take the form of a casing or substrate having different electro-conductive portions, or an electrically resistive metallic tube. Alternatively, the electric heater may comprise one or more heating needles or rods that run through the centre of the aerosol-forming substrate. Alternatively, the electric heater may be a disk (end) heater or a combination of a disk heater with heating needles or rods. The electric heater may comprise one or more stamped portions of electrically resistive material, such as stainless steel. Other alternatives include a heating wire or filament, for example a Ni—Cr (Nickel-Chromium), platinum, tungsten or alloy wire or a heating plate.

In certain preferred embodiments, the electric heater comprises a plurality of electrically conductive filaments. The plurality of electrically conductive filaments may form a mesh or array of filaments or may comprise a woven or non-woven fabric.

The electrically conductive filaments may define interstices between the filaments and the interstices may have a width of between 10 μm and 100 μm. Preferably the filaments give rise to capillary action in the interstices, so that in use, liquid to be vaporised is drawn into the interstices, increasing the contact area between the heater assembly and the liquid. The electrically conductive filaments may form a mesh of size between 160 and 600 Mesh US (+/−10 percent) (i.e. between 160 and 600 filaments per inch (+/−10 percent)). The width of the interstices is preferably between 25 μm and 75 μm. The percentage of open area of the mesh, which is the ratio of the area of the interstices to the total area of the mesh, is preferably between 25 percent and 56 percent. The mesh may be formed using different types of weave or lattice structures. The mesh, array or fabric of electrically conductive filaments may also be characterised by its ability to retain liquid, as is well understood in the art. The electrically conductive filaments may have a diameter of between 10 μm and 100 μm, preferably between 8 μm and 50 μm, and more preferably between 8 μm and 39 μm. The filaments may have a round cross section or may have a flattened cross-section. The heater filaments may be formed by etching a sheet material, such as a foil. This may be particularly advantageous when the heater assembly comprises an array of parallel filaments. If the heater assembly comprises a mesh or fabric of filaments, the filaments may be individually formed and knitted together. The electrically conductive filaments may be provided as a mesh, array or fabric. The area of the mesh, array or fabric of electrically conductive filaments may be small, preferably less than or equal to 25 mm2, allowing it to be incorporated in to a handheld system. The mesh, array or fabric of electrically conductive filaments may, for example, be rectangular and have dimensions of 5 mm by 2 mm. Preferably, the mesh or array of electrically conductive filaments covers an area of between 10 percent and 50 percent of the area of the heater assembly. More preferably, the mesh or array of electrically conductive filaments covers an area of between 15 percent and 25 percent of the area of the heater assembly.

Optionally, the heating element may be deposited in or on a carrier material. In certain preferred embodiments, the heating element is deposited on an electrically insulating substrate foil. The substrate foil may be flexible. The substrate foil may be polymeric. The substrate foil may be a multi-layer polymeric foil. The heating element, or heating elements, may extend across one or more apertures in the substrate foil.

In one embodiment, electric energy is supplied to the electric heater until the heating element or elements of the electric heater reach a temperature of between approximately 180 degrees Celsius and about 310 degrees Celsius. Any suitable temperature sensor and control circuitry may be used in order to control heating of the heating element or elements to reach the required temperature. This is in contrast to conventional cigarettes in which the combustion of tobacco and cigarette wrapper may reach 800 degrees Celsius.

Preferably, the minimum distance between the electric heater and the at least one aerosol-forming substrate is less than 50 micrometres, preferably the cartridge comprises one or more layers of capillary fibres in the space between the electric heater and the aerosol-forming substrate.

The electric heater may comprise one or more heating elements positioned between the base layer and the at least one aerosol-forming substrate. In preferred embodiments, the electric heater may comprise one or more heating elements positioned on the opposite side of the at least one aerosol-forming substrate to the base layer. With this arrangement, heating of the aerosol-forming substrate and aerosol release occur on the same side of the aerosol-forming substrate. This has been found to be particularly effective for aerosol-forming substrates which comprise a liquid nicotine source. In certain embodiments, the heater comprises one or more heating elements positioned adjacent to opposite sides of the aerosol-forming substrate. Preferably the electric heater comprises a plurality of heating elements arranged to heat a different portion of the aerosol-forming substrate. In certain preferred embodiments, the at least one aerosol-forming substrate comprises a plurality of aerosol-forming substrates arranged separately on the base layer and the electric heater comprises a plurality of heating elements each arranged to heat a different one of the plurality of aerosol-forming substrates.

In use, the cartridge may be connected to a separate mouthpiece portion by which a user can draw a flow of air through or adjacent to the cartridge by sucking on a downstream end of the mouthpiece portion. For example, the mouthpiece portion may be provided as part of an aerosol-generating device with which the cartridge is combined to form an aerosol-generating system. In such embodiments, the cartridge may comprise a flange for attaching a detachable mouthpiece portion. In certain preferred embodiments, the cartridge further comprises an integral mouthpiece portion. In such embodiments, preferably, the cartridge is arranged such that the resistance to draw at a downstream end of the mouthpiece portion is from about 50 mmWG to about 130 mmWG, preferably from about 80 mmWG to about 120 mmWG, more preferably from about 90 mmWG to about 110 mmWG, most preferably from about 95 mmWG to about 105 mmWG. As used herein, the term "resistance to draw" refers the pressure required to force air through the full length of the object under test at the rate of 17.5 ml/sec at 22 degrees Celsius and 101 kPa (760 Torr), is typically expressed in units of millimeters water gauge (mmWG) and is measured in accordance with ISO 6565: 2011.

In any of the embodiments described above, the aerosol-forming cartridge may comprise a data storage device configured to communicate data to an aerosol-generating device when the aerosol-forming cartridge is coupled to the device. The data stored on the aerosol-forming cartridge may include at least one of the type of aerosol-forming cartridge, the manufacturer, the date and time of manufacture, a production batch number, a heating profile, and an indication of whether the aerosol-forming cartridge has been used previously.

In addition to a data storage device, or as an alternative to a data storage device, the aerosol-forming cartridge may comprise an electrical load configured to electrically connect with an aerosol-generating device when the aerosol-forming cartridge is coupled to the device. The electrical load may comprise at least one of a resistive load, a capacitive load and an inductive load. The aerosol-generating device can be configured to control a supply of electrical current to the cartridge based at least in part on the measured electrical load. Thus, the electrical load can be used to identify the type of cartridge.

In a particularly preferred embodiment, the at least one electric load comprises a resistive electric heater. Utilising the heater itself as the resistive load can eliminate the need for a separate and dedicated electrical load that may otherwise be provided specifically for the purpose of distinguishing between different cartridges. The cartridge may comprise electrical contacts to provide an electrical connection between the cartridge and an aerosol-generating device with which the cartridge may be coupled.

The electrical contacts may be accessible from outside of the cartridge. The electrical contacts may be positioned along one or more edges of the cartridge. In certain embodiments, the electrical contacts may be positioned along a lateral edge of the cartridge. For example, the electrical contacts may be positioned along the upstream edge of the cartridge. Alternatively, or in addition, the electrical contacts may be positioned along a single longitudinal edge of the cartridge.

The electrical contacts may comprise power contacts for supplying power to the cartridge as well as data contacts for transferring data to or from the cartridge, or both to and from the cartridge.

The electrical contacts may have any suitable form. The electrical contacts may be substantially flat. Advantageously, substantially flat electrical contacts have been found to be more reliable for establishing an electrical connection and are easier to manufacture. Preferably, the electrical contacts comprise part of a standardised electrical connection, including, but not limited to, USB-A, USB-B, USB-mini, USB-micro, SD, miniSD, or microSD type connections. Preferably, the electrical contacts comprise the male part of a standardised electrical connection, including, but not limited to, USB-A, USB-B, USB-mini, USB-micro, SD, miniSD, or microSD type connections. As used herein, the term "standardised electrical connection" refers an electrical connection which is specified by an industrial standard.

The electrical contacts may be formed integrally with the electric circuitry. In certain preferred embodiments, the cartridge comprises an electric heater to which the electrical contacts are connected. In such embodiments, the electric heater may comprise an electrically insulating substrate foil on or in which the electrical contacts and one or more heating elements are disposed.

In certain embodiments, the cartridge may comprise a cover layer fixed to the base layer and over at least part of the at least one aerosol-forming substrate. Advantageously, the cover layer may hold the at least one aerosol-forming substrate in place on the base layer. The cover layer may be fixed to the base layer by virtue of being formed integrally with the base layer. Alternatively, the cover layer may be a separate component fixed directly to the base layer, or indirectly via one or more intermediate layers or components. Aerosol released by the aerosol-forming substrate may pass through one or more apertures in the cover layer, base layer, or both. The cover layer may have at least one gas permeable window to allow aerosol released by the aerosol-forming substrate to pass through the cover layer. The gas permeable window may be substantially open. Alternatively, the gas permeable window may comprise a perforated membrane, or a grid extending across an aperture in the cover layer. The grid may be of any suitable form, such as a transverse grid, longitudinal grid, or mesh grid. The cover layer may form a seal with the base layer. The cover layer may form a hermetic seal with the base layer. The cover layer may comprise a polymeric coating at least where the cover layer is fixed to the base layer, the polymeric coating forming a seal between the cover layer and the base layer.

The aerosol-forming cartridge may comprise a protective foil positioned over at least part of the at least one aerosol-forming substrate. The protective foil may be gas impermeable. The protective foil may be arranged to hermetically seal the aerosol-forming substrate within the cartridge. As used herein, the term "hermetically seal" means that the weight of the volatile compounds in the aerosol-forming substrate changes by less than 2 percent over a two week period, preferably over a two month period, more preferably over a two year period.

Where the base layer comprises at least one cavity in which the aerosol-forming substrate is held, the protective foil may be arranged to close the one or more cavities. The protective foil may be at least partially removable to expose the at least one aerosol-forming substrate. Preferably, the protective foil is removable. Where the base layer comprises a plurality of cavities in which a plurality of aerosol-forming substrates are held, the protective foil may be removable in stages to selectively unseal one or more of the aerosol-forming substrate. For example, the protective foil may comprise one or more removable sections, each of which is arranged to reveal one or more of the cavities when removed from the remainder of the protective foil. Alternatively, or in addition, the protective foil may be attached such that the required removal force varies between the various stages of removal as an indication to the user. For example, the required removal force may increase between adjacent stages so that the user must deliberately pull harder on the protective foil to continue removing the protective foil. This may be achieved by any suitable means. For example, the required removal force may be varied by altering the type, quantity, or shape of an adhesive layer, or by altering the shape or amount of a weld line by which the protective foil is attached.

The protective foil may be removably attached to the base layer either directly or indirectly via one or more intermediate components. Where the cartridge comprises a cover layer as described above, the protective foil may be removably attached to the cover layer. Where the cover layer has one or more gas permeable windows, the protective foil may extend across and close the one or more gas permeable windows. The protective foil may be removably attached by any suitable method, for example using adhesive. The protective foil may be removably attached by ultrasonic welding. The protective foil may be removably attached by ultrasonic welding along a sealing line. The sealing line may be continuous. The sealing line may comprise two or more continuous weld lines arranged side by side. With this arrangement, the seal can be maintained provided at least one of the continuous weld lines remains intact.

The protective foil may be a flexible film. The protective foil may comprise any suitable material or materials. For example, the protective foil may comprise a polymeric foil. The polymeric foil may comprise any suitable material, such as, but not limited to, one or more of a Polyimide (PI), a Polyaryletherketone (PAEK), such as Polyether Ether Ketone (PEEK), Poly Ether Ketone (PEK), or Polyetherketoneetherketoneketone (PEKEKK), or a Fluoric polymer, such as Polytetrafluoroethylene (PTFE), Polyvinylidene Fluoride (PVDF), Ethylene tetrafluoroethylene (ETFE), PVDFELS, or Fluorinated Ethylene Propylene (FEP). The protective foil may comprise a multilayer polymeric foil.

The aerosol-forming cartridge may comprise an air inlet and an air outlet connected by an air flow channel in fluid communication with the aerosol-forming substrate when the cartridge is in use. The air flow channel may have an internal wall surface on which one or more flow disturbing devices are disposed, the flow disturbing devices being arranged to create a turbulent boundary layer in a flow of air drawn through the air flow channel. In some embodiments, the flow disturbing devices comprise one or more dimples or undulations on the internal wall surface. According to a second aspect of the present invention, there is provided an electrically operated aerosol-forming system comprising an aerosol-generating device, and an aerosol-forming cartridge as described in any of the embodiments above, the device comprising: a main body defining a slot-shaped receptacle for removably receiving the aerosol-forming cartridge; and an electric power supply for supplying power to the electric heater.

According to a third aspect of the present invention, there is provided a method of manufacturing an aerosol-forming cartridge for use in an electrically operated aerosol-generating system, the method comprising the steps of: providing a base layer on an assembly line; placing at least one aerosol-forming substrate on the base layer such that the base layer and the at least one aerosol-forming substrate are in contact at a contact surface which is substantially planar, wherein the aerosol-forming substrate comprises a liquid nicotine source, and attaching an electric heater to the base layer such that the electric heater and the base layer are in contact at a contact surface which is substantially planar and is substantially parallel to the contact surface between the base layer and the at least one aerosol-forming substrate.

The base layer may be formed from a single component. Alternatively, the base layer may comprise multiple layers or components which combine to form the base layer. The base layer may have a substantially planar top surface and the step of placing at least one aerosol-forming substrate on the base layer may be carried out by placing the aerosol-forming substrate on the substantially planar top surface.

In certain preferred embodiments, the method further comprises the step of forming at least one cavity in the base layer, wherein the step of placing at least one aerosol-forming substrate on the base layer is carried out by placing the at least one aerosol-forming substrate in the at least one cavity. The cavity may be pre-formed in the base layer. In certain embodiments, the base layer comprises one or more moulded components and the cavity is formed by the mould in which the one or more moulded components are made. In such embodiments, the base layer may be injection-moulded. Alternatively, the cavity may be formed in an existing base layer component by thermoforming or cold forming. The cavity may be formed in an existing base layer component using mechanical action, or under an applied pressure, vacuum, or any combination thereof. In certain embodiments, the step of providing a base layer comprises feeding a web of base layer foil to the assembly line and the step of forming at least one cavity in the base layer is carried out by thermoforming or cold forming a blister in the web of base layer foil.

The electric heater may be attached directly to the base layer or indirectly via one or more intermediate components. The electric heater may be attached by any suitable method, for example by lamination, welding, gluing, or by mechanical fixation, such as being held in place by another component of the cartridge.

The electric heater may be pre-formed and placed in the cartridge as an individual component. In certain embodiments the step of attaching an electric heater is carried out by feeding a web of electric heater foil from a bobbin to the assembly line and cutting the web of electric heater foil transversely to form individual electric heaters. As used herein, the term "transversely" refers to a direction substantially perpendicular to the direction of a stream of components on the assembly line. The electric heater foil may comprise one or more electrically conductive layers, such as aluminium foil, from which the heater may be formed, for example by cutting one or more heating elements into the foil. In certain embodiments, the web of electric heater foil comprises a web of electrically insulating substrate foil to which a plurality of heating elements is attached. The electrically insulating substrate foil may comprise one or more electrically insulating layers of polymeric foil. The polymeric foil may comprise any suitable material, such as, but not limited to, one or more of a Polyimide (PI), a Polyaryletherketone (PAEK), such as Polyether Ether Ketone (PEEK), Poly Ether Ketone (PEK), or Polyetherketoneetherketoneketone (PEKEKK), or a Fluoric polymer, such as Polytetrafluoroethylene (PTFE), Polyvinylidene Fluoride (PVDF), Ethylene tetrafluoroethylene (ETFE), PVDFELS, or Fluorinated Ethylene Propylene (FEP). In one particular embodiment, the electric heater foil comprises a stainless steel heating element sandwiched between two layers of polymer foil.

The base layer may be formed by any suitable method. In certain embodiments, each base layer is formed from an injection-moulded polymeric material, such as, but not limited to, one or more of a Polyaryletherketone (PAEK), such as Polyether Ether Ketone (PEEK), Poly Ether Ketone (PEK), or Polyetherketoneetherketoneketone (PEKEKK), a Polyphenylensulfide, such as Polypropylene (PP), Polyphenylene sulfide (PPS), or Polychlorotrifluoroethene (PCTFE or PTFCE), a Polyarylsulfone, such as Polysulfone (PSU), Polyphenylsulfone (PPSF or PPSU), Polyethersulfone (PES), or Polyethylenimine (PEI), or a Fluoric polymer, such as Polytetrafluoroethylene (PTFE), Polyvinylidene Fluoride (PVDF), Ethylene tetrafluoroethylene (ETFE), PVDFELS, or Fluorinated Ethylene Propylene (FEP).

Alternatively, the step of providing a base layer comprises feeding a web of base layer foil from a bobbin to the assembly line and cutting the web of base layer foil transversely to form individual base layers. Alternatively, or in addition, the step of providing a base layer may comprise providing a web of substrate foil and a web of intermediate foil, attaching the webs of substrate foil and intermediate foil together to form a web of base layer foil and cutting the web of base layer foil transversely to form individual base layers. The web of substrate foil may comprise part of a web of electric heater foil. In such embodiments, the method may comprise the step of attaching an electric heater to the base layer, wherein the web of substrate foil is formed by a web of electrically insulating substrate foil to which a plurality of heating elements is attached. The web of base layer foil may comprise any suitable material or materials. For example, the web of base layer foil may comprise one or more layers of a polymeric foil. The polymeric foil may comprise any suitable material, such as, but not limited to, one or more of a Polyimide (PI), a Polyaryletherketone (PAEK), such as Polyether Ether Ketone (PEEK), Poly Ether Ketone (PEK), or Polyetherketoneetherketoneketone (PEKEKK), or a Fluoric polymer, such as Polytetrafluoroethylene (PTFE), Polyvinylidene Fluoride (PVDF), Ethylene tetrafluoroethylene (ETFE), PVDFELS, or Fluorinated Ethylene Propylene (FEP).

The method may further comprise the step of providing a cover layer over the at least one aerosol-forming substrate and attaching the cover layer to the base layer. Advantageously, the cover layer is arranged to hold the at least one aerosol-forming substrate in place on the base layer. In certain embodiments, the cover layer is formed from an injection-moulded polymer. In such embodiments, the cover layer may comprise any suitable material or materials. For example, an injection moulded cover layer may be formed from an injection-moulded polymeric material, such as, but not limited to, one or more of a Polyaryletherketone (PAEK), such as Polyether Ether Ketone (PEEK), Poly Ether Ketone (PEK), or Polyetherketoneetherketoneketone (PEKEKK), a Polyphenylensulfide, such as Polypropylene (PP), Polyphenylene sulfide (PPS), or Polychlorotrifluoroethene (PCTFE or PTFCE), a Polyarylsulfone, such as Polysulfone (PSU), Polyphenylsulfone (PPSF or PPSU), Polyethersulfone (PES), or Polyethylenimine (PEI), or a Fluoric polymer, such as Polytetrafluoroethylene (PTFE), Polyvinylidene Fluoride (PVDF), Ethylene tetrafluoroethylene (ETFE), PVDFELS, or Fluorinated Ethylene Propylene (FEP).

Alternatively, the step of providing a cover layer may comprise unwinding a web of cover layer foil from a bobbin and attaching the cover layer foil to the base layer foil. The cover layer foil may be attached to the base layer foil by any suitable method, for example by welding. The web of cover layer foil may comprise any suitable material or materials. For example, the web of cover layer foil may comprise one or more layers of a polymeric foil. The polymeric foil may comprise any suitable material, such as, but not limited to, one or more of a Polyimide (PI), a Polyaryletherketone (PAEK), such as Polyether Ether Ketone (PEEK), Poly Ether Ketone (PEK), or Polyetherketoneetherketoneketone (PEKEKK), or a Fluoric polymer, such as Polytetrafluoroethylene (PTFE), Polyvinylidene Fluoride (PVDF), Ethylene tetrafluoroethylene (ETFE), PVDFELS, or Fluorinated Ethylene Propylene (FEP).

The method may further comprise the step of providing a protective foil over the at least one aerosol-forming substrate to restrict the release of volatile compounds from the aerosol-forming substrate. The protective foil may be arranged to hermetically seal the aerosol-forming substrate within the cartridge. The step of providing a protective foil may comprise unwinding a web of protective foil from a bobbin and attaching the protective foil to the base layer foil, either directly, or indirectly via one or more intermediate layers. The protective foil may be attached to the base layer foil by any suitable method, for example by welding. The protective foil may comprise any suitable material or materials. For example, the protective foil may comprise one or more layers of polymeric foil. The polymeric foil may comprise any suitable material, such as, but not limited to, one or more of a Polyimide (PI), a Polyaryletherketone (PAEK), such as Polyether Ether Ketone (PEEK), Poly Ether Ketone (PEK), or Polyetherketoneetherketoneketone (PEKEKK), or a Fluoric polymer, such as Polytetrafluoroethylene (PTFE), Polyvinylidene Fluoride (PVDF), Ethylene tetrafluoroethylene (ETFE), PVDFELS, or Fluorinated Ethylene Propylene (FEP).

The method may further comprise the step of providing a top cover attached to the base layer and over the aerosol-forming substrate. The top cover may comprise an air inlet and an air outlet connected by an air flow channel. The top cover may be formed from a single component. Alternatively, the top cover may comprise multiple layers or components which combine to form the top cover. The top cover may have a substantially planar top surface. In certain preferred embodiments, the method further comprises the step of forming at least one cavity in the top cover to at least partially define the air flow channel. The cavity may be pre-formed in the top cover. In certain embodiments, the top cover comprises one or more moulded components and the cavity is formed by the mould in which the one or more moulded components are made. In such embodiments, the top cover may be injection-moulded. Alternatively, the cavity may be formed in an existing top cover component by thermoforming or cold forming. The cavity may be formed in an existing top cover component using mechanical action, or under an applied pressure, vacuum, or any combination thereof. In certain embodiments, the step of providing a top cover comprises feeding a web of top cover foil to the assembly line and the step of forming at least one cavity in the top cover is carried out by thermoforming or cold forming a blister in the web of top cover foil.

Where one or more of the components of the cartridge are formed from one or more webs of foil, the one or more webs of foil may be single width. In other words, each web may have substantially the same width as the respective component of the cartridge that the web is used to form. In certain preferred embodiments, the one or more webs of foil may each have a width that is from about two times to about 50 times greater than the width of the respective component that the web is used to form. Advantageously, this allows a plurality of aerosol-forming cartridges to be made in parallel.

Where one or more of the components of the cartridge are formed from two or more webs of foil, the two webs of foil may be attached together by any suitable method, for example using adhesive, by welding, by fusing, or any combination thereof. In one particular embodiment, two or more layers of the cartridge are laminated together. In such an example, two layers are pressed together and one or both are partially melted, for example using heat, ultrasound, or both, to fuse the layers together.

The method may comprise conveying the cartridge components on a conveyor. The conveyor may be a continuous conveyor, such as a conveyor belt. The conveyor may have a plurality of cavities for receiving one or more components of the cartridge during manufacture to ensure correct placement of those components on the conveyor. The cavities may be arranged in two or more parallel rows. The cavities may be arranged in a grid. Advantageously, this allows a plurality of aerosol-forming cartridges to be made in parallel. Alternatively, the conveyor may comprise one or more webs of foil from which the cartridges are made and which are pulled along the assembly line by a drive wheel or other driving means. For example, the conveyor may comprise the web of base layer foil.

According to a fourth aspect of the invention, there is provided a method of manufacturing an aerosol-forming cartridge according to any of the embodiments described above.

Although the disclosure has been described by reference to different aspects, it should be clear that features described in relation to one aspect of the disclosure may be applied to the other aspects of the disclosure.

Figure 1B:
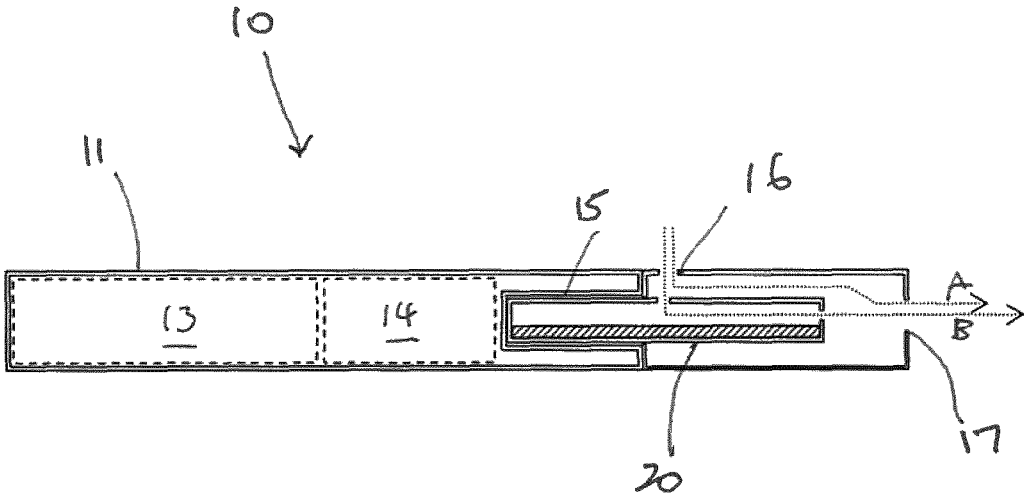

FIGS. 1A and 1B show an aerosol-generating device 10 and a separate, removable aerosol-forming cartridge 20, which together form an aerosol-generating system. The device 10 is portable and has a size comparable to a conventional cigar or cigarette. The device 10 comprises a main body 5 and a removable mouthpiece portion 12. The main body 12 contains a battery 13, such as a lithium iron phosphate battery, electric circuitry 14 and a slot-shaped cavity 15. The mouthpiece portion 12 fits over the cartridge and is connected to the main body 5 by a releasable connecting means (not shown). The mouthpiece portion 12 can be removed (as shown in FIG. 1A) to allow for insertion and removal of cartridges and is connected to the main body 5 when the system is to be used to generate aerosol, as will be described. The mouthpiece portion 12 comprises an air inlet 16 and an air outlet 17, each of which may comprise one or more orifices. In use, a user sucks or puffs on the air outlet 17 to draw air from the air inlet 16, through the mouthpiece portion 12 to the air outlet 17, and thereafter into the mouth or lungs of the user. A flow of air drawn through the mouthpiece portion 12 may be drawn past the cartridge 20 (as shown by the arrows marked as "A" in FIG. 1B), or also through one or more air flow channels in the cartridge 20 (as indicated by the arrows marked as "B" in FIG. 1B). The cavity 15 has a rectangular cross-section and is sized to receive at least part of the cartridge 20 to removably connect the device 10 and the cartridge 20. As used herein, the term "removably connect" means that the device and the cartridge can be coupled and uncoupled from one another without significant damage to either. Electrical contacts (not shown) are provided within the cavity 15 to provide an electrical connection between the electric circuitry of the device and corresponding electrical contacts on the cartridge 20.

Figure 2A:
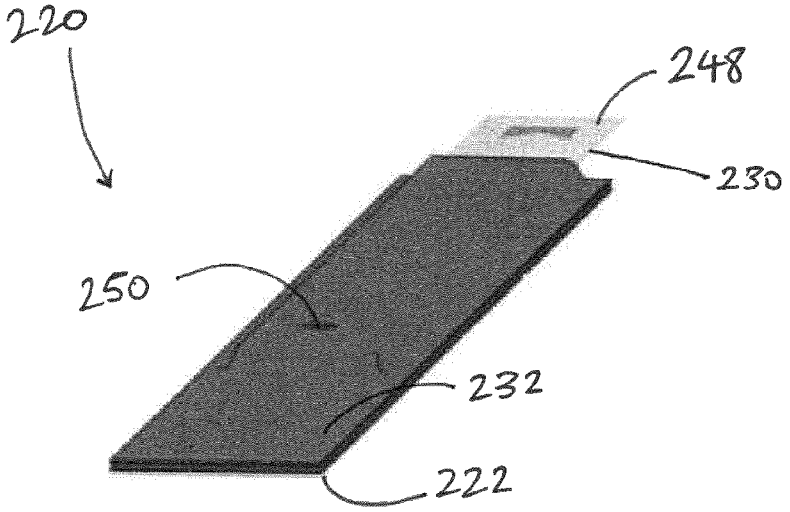
FIGS. 2A and 2B show a first embodiment of an aerosol-forming cartridge in accordance with the present invention, where
Figure 2B:
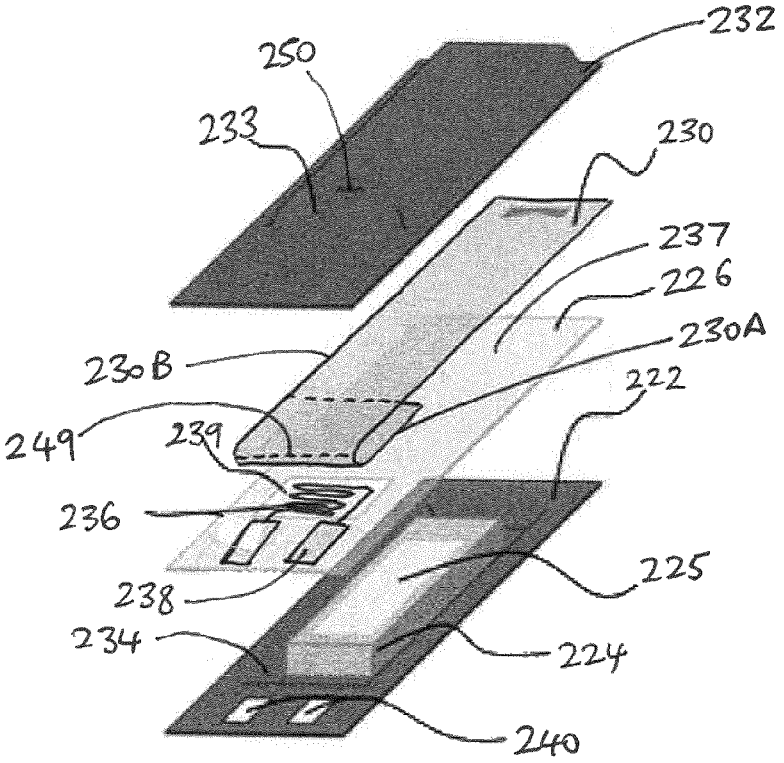

FIGS. 2A and 2B show a second embodiment of aerosol-forming cartridge 220. The cartridge 220 has a generally rectangular cross-section, although it could be any other suitable flat shape. The cartridge comprises a base layer 222, an aerosol-forming substrate 224 arranged on the base layer 222, a heater 226 positioned over the aerosol-forming substrate 224, a protective foil 230 over the heater 226, and a top cover 232 fixed to the base layer 222 and over the protective foil 230. The aerosol-forming substrate 224, the heater 226 and the protective foil 230 are all substantially flat and substantially parallel to each other. The contact surfaces between any two of the base layer 222, the aerosol-forming substrate 224, the heater 226 the protective foil 230, and the top cover 232 are substantially planar and substantially parallel with each other.

The base layer 222 is formed from a substantially planar sheet with a downwardly extending blister defining a cavity 234 on its top surface in which the aerosol-forming substrate 224 is held. The aerosol-forming substrate 224 comprises a liquid nicotine source. In this example, the aerosol-forming substrate 224 comprises a liquid nicotine source absorbed in a substantially flat rectangular block of a porous carrier material. A capillary patch 225 is provided on the top surface of the carrier material to assist with drawing the liquid substrate to the top surface of the carrier material for evaporation.

The heater 226 comprises a heating element 236 connected to electrical contacts 238. In this example, the heating element 236 and electrical contacts 238 are integral and the heater 226 is formed by disposing heating element 236 and electrical contacts 238 on an electrically insulating substrate foil 237 such that the heating element 236 extends across an opening 239 formed in the electrically insulating substrate foil 237. In use, aerosol released by the aerosol-forming substrate 224 passes through the opening 239 in the electrically insulating substrate foil 237 and through the heating element 236. The electrically insulating substrate foil 237 is sized to fit over the cavity 234 in the base layer 222 and helps to keep the aerosol-forming substrate 224 in position on the base layer 222. In this example, the electrically insulating substrate foil 237 extends laterally beyond the cavity 234 and has substantially the same width and length as the base layer 222 so the edges of the cover layer 228 and the base layer 222 are generally aligned. The base layer 222 has two contact apertures 240 at its distal end into which the electrical contacts 238 extend. The electric contacts 238 are accessible from outside of the cartridge through the contact apertures 240.

The protective foil 230 is removably attached to the top of the heater 226 and over the opening 239 in the electrically insulating substrate foil 237 to seal the aerosol-forming substrate 224 within the cartridge 220. The protective foil 230 comprises a substantially impermeable sheet that is welded to the heater 226 but which can be easily peeled off. The sheet is welded to the heater 226 along a continuous sealing line formed of two continuous weld lines arranged side by side. The protective foil 230 acts to prevent substantial loss of volatile compounds from the aerosol-forming substrate 224 prior to use of the cartridge 220. A tab 248 is provided at the free end of the protective foil 230 to allow a user to grasp the protective foil 230 to peel it off from over the opening 239. The tab 248 is formed by an extension of the protective foil 230 and extends beyond the edge of the top cover 232. To facilitate removal, the protective foil 230 is folded over itself at a transverse fold line 249 such that the protective foil 230 is divided into a first portion 230A, which is attached to the heater 226 by the continuous sealing line, and a second portion 230B, which extends longitudinally from the fold line 249 to the tab 248. The section portion 230B lies flat against the first portion 230A so that the first and second portions 230A, 230B are substantially co-planar. With this arrangement, the protective foil 230 can be removed by pulling the tab 248 longitudinally to peel the first portion 230A away from the heater 226 at the fold line 249.

It will be apparent to one of ordinary skill in the art that, although welding is described as the method to secure the removable protective foil 230 to the heater 226, other methods familiar to those in the art may also be used including, but not limited to, heat sealing or gluing, provided the protective foil 230 may easily be removed by a consumer.

The top cover 232 is formed from a substantially planar sheet with an upwardly extending blister 233 on its top surface. The top cover 232 includes an air inlet 250 towards the distal end of the blister and an air outlet (not shown) at its proximal end. The air inlet 250 and the air outlet are connected by an air flow channel defined by the blister 233.

During use, the protective foil 230 is removed by pulling the tab 248 in a longitudinal direction and away from the cartridge 220. Once the protective foil 230 has been removed, the aerosol-forming substrate 224 is in fluid communication with the air flow channel via the opening 239 in the electrical insulating substrate 237. The cartridge 220 is then inserted into an aerosol-generating device, as shown in FIGS. 1A and 1B, so that the electrical contacts 238 connect with the corresponding electrical contacts in the cavity of the device. Electrical power is then provided by the device to the heater 226 of the cartridge to release aerosol from the aerosol-forming substrate. When a user sucks or puffs on the mouthpiece portion of the device, air is drawn from the air inlets in the mouthpiece, into the air inlet 250 of the top cover and through the air flow channel in the top cover 232, where it is mixed with the aerosol. The air and aerosol mixture is then drawn through the air outlet of the cartridge 220 to the outlet of the mouthpiece portion.

Once the aerosol-forming substrate 224 has been consumed by a user, the cartridge is removed from the cavity of the device and replaced.

Figure 3A:
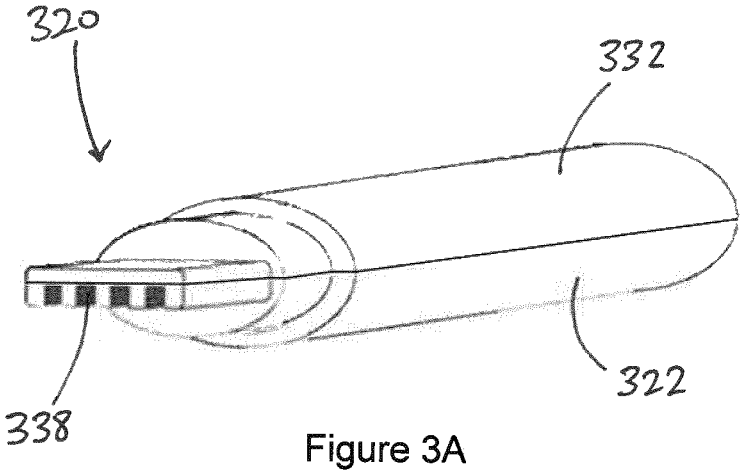
FIGS. 3A and 3B show a second embodiment of an aerosol-forming cartridge in accordance with the present invention, where
Figure 3B:
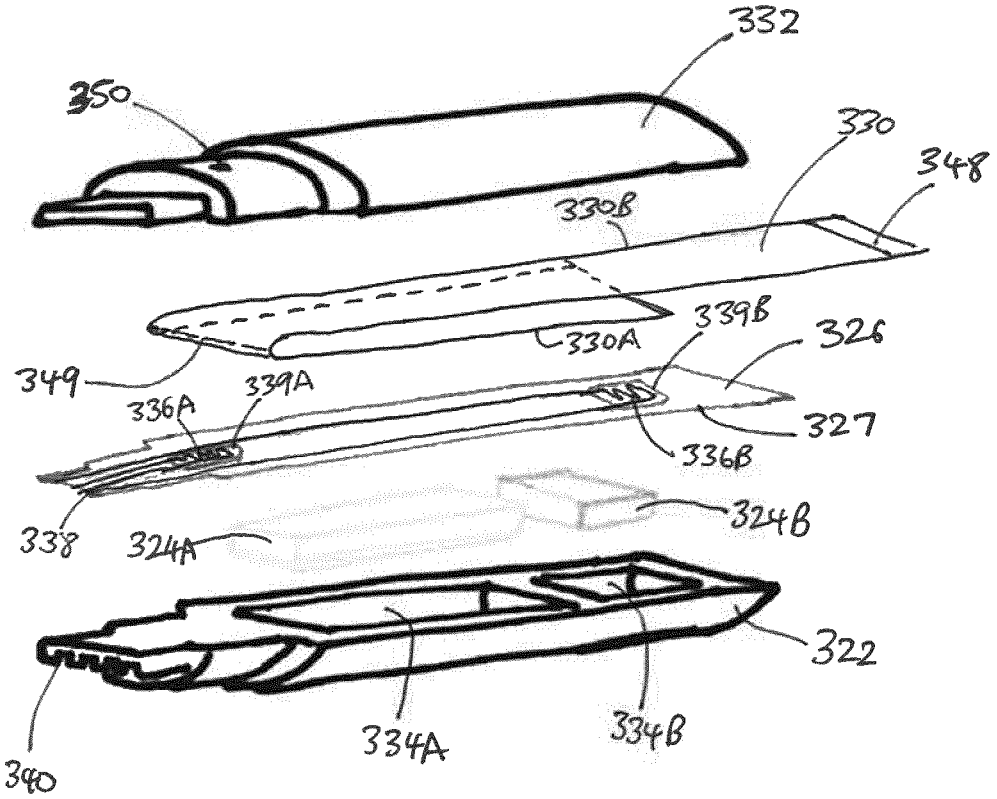

FIGS. 3A and 3B show a second embodiment of aerosol-forming cartridge 320. The cartridge 320 has a generally cylindrical shape with an oval cross-section, although it could be any other suitable flat shape, such as a polygonal shape. The shape of the cartridge 320 is defined by a base layer 322 and a top cover 332 attached to the base layer 322 to complete the outer shape of the cartridge 320. The cartridge 320 also comprises first and second aerosol-forming substrates 324A, 324B arranged on the base layer 322, a heater 326 positioned over the aerosol-forming substrates 324A, 324B and a protective foil 330 over the heater 326. The aerosol-forming substrates, the heater 326 and the protective foil 330 are all substantially flat and substantially parallel to each other. The contact surfaces between any two of the base layer 322, the aerosol-forming substrates, the heater 326 the protective foil 330, and the top cover 332 are substantially planar and substantially parallel.

The base layer 322 has first and second cavities 334A, 334B on its top surface. The first aerosol-forming substrate 324A is held in the first cavity 334A and the second aerosol-forming substrate 324B is held in the second cavity 334B. One or both of the aerosol-forming substrates comprises a liquid nicotine source. In this example, the first and second aerosol-forming substrates 324A, 324B each comprise a liquid substrate absorbed in a substantially flat rectangular block of a porous carrier material. A capillary patch (not shown) is provided on the top surface of the carrier material to assist with drawing the liquid substrate to the top surface of the carrier material for evaporation. Since the first and second aerosol-forming substrates are held separately, it is possible to use incompatible aerosol-forming substrates in the same cartridge.

The heater 326 comprises first and second heating elements 336A, 336B connected to four electrical contacts 338. In this example, the heating elements 336A, 336B and electrical contacts 338 are integral and the heater 326 is formed by disposing heating elements 336A, 336B and electrical contacts 338 on an electrically insulating substrate foil 337 such that the first heating element 336A extends across a first opening 339A formed in the electrically insulating substrate foil 337 and the second heating element 336B extends across a second opening 339B formed in the electrically insulating substrate foil 337. In use, aerosol released by the first aerosol-forming substrate 324A passes through the first opening 339A and the first heating element 336A, while aerosol released by the second aerosol-forming substrate 324B passes through the second opening 339B and the second heating element 336B. The electrically insulating substrate foil 337 is sized to fit over the cavities 334A, 334B in the base layer 322 and helps to keep the aerosol-forming substrates in position on the base layer 322. The base layer 322 has four contact apertures 340 at its distal end into which the electrical contacts 338 extend. The electric contacts 338 are accessible from outside of the cartridge through the contact apertures 340.

The protective foil 330 is removably attached to the top of the heater 326 and over the first and second openings 339A, 339B in the electrically insulating substrate foil 337 to seal the aerosol-forming substrates within the cartridge 320. The protective foil 330 comprises a substantially impermeable sheet that is welded to the base layer 322 but which can be easily peeled off. The sheet is welded to the heater 326 along a continuous sealing line formed of two continuous weld lines arranged side by side. The protective foil 330 acts to prevent substantial loss of volatile compounds from the aerosol-forming substrates prior to use of the cartridge 320. A tab 348 is provided at the free end of the protective foil 330 to allow a user to grasp the protective foil 330 when peeling it off. The tab 348 is formed by an extension of the protective foil 330 and extends beyond the edge of the top cover 332. To facilitate removal, the protective foil 330 is folded over itself at a transverse fold line 349 such that the protective foil 330 is divided into a first portion 330A, which is attached to the heater 326 by the continuous sealing line, and a second portion 330B, which extends longitudinally from the fold line 349 to the tab 348. The section portion 330B lies flat against the first portion 330A so that the first and second portions 330A, 330B are substantially co-planar. With this arrangement, the protective foil 330 can be removed by pulling the tab 348 longitudinally to peel the first portion 330A away from the heater 326 at the fold line 349.

It will be apparent to one of ordinary skill in the art that, although welding is described as the method to secure the removable protective foil 330 to the heater 326, other methods familiar to those in the art may also be used including, but not limited to, heat sealing or gluing, provided the protective foil 330 may easily be removed by a consumer.

The top cover 332 is hollow and includes an air inlet 350 towards its distal end and an air outlet (not shown) at its proximal end. The air inlet 350 and the air outlet are connected by an air flow channel (not shown) which is defined between an internal wall surface (not shown) of the hollow top cover 332 and the heater 326 below.

During use, the protective foil 330 is peeled away from over the first opening 339A by pulling the tab 348 in a longitudinal direction and away from the cartridge 320. Once the protective foil 330 has been peeled away from the first opening 339A, the first aerosol-forming substrate 324A is in fluid communication with the air flow channel via the first opening 339A. The protective foil 330 can also be peeled away from over the second opening 339B by continuing to pull the tab 348 in the same direction. Once the protective foil 330 has been peeled away from the second opening 339B, the second aerosol-forming substrate 324B is in fluid communication with the air flow channel via the first opening 339B. The pull force required to remove the protective foil 330 away from the cartridge 320 can vary to indicate to the user when the first or second openings 339A, 339B are being revealed. For example, the adhesive force between the heater 326 and the protective foil 330 could change between the first and second openings 339A, 339B by altering the amount of composition of the adhesive used.

Once the protective foil 330 has been partially or completely removed from the cartridge 320, the electric contacts 338 of the cartridge 320 are inserted into the cavity of an aerosol-generating device, as shown in FIGS. 1A and 1B, so that the electrical contacts 338 connect with the corresponding electrical contacts in the cavity of the device. Electrical power is then provided by the device to the heater 326 of the cartridge to release aerosol from one or both of the aerosol-forming substrates. When a user sucks or puffs on the mouthpiece portion of the device, air is drawn from the air inlets in the mouthpiece, into the air inlet 350 of the top cover and through the air flow channel in the top cover 332, where it is mixed with the aerosol. The air and aerosol mixture is then drawn through the air outlet of the cartridge 320 to the outlet of the mouthpiece portion.

Once the cartridge has been consumed by a user, it is removed from the cavity of the device and replaced.

Figure 4:
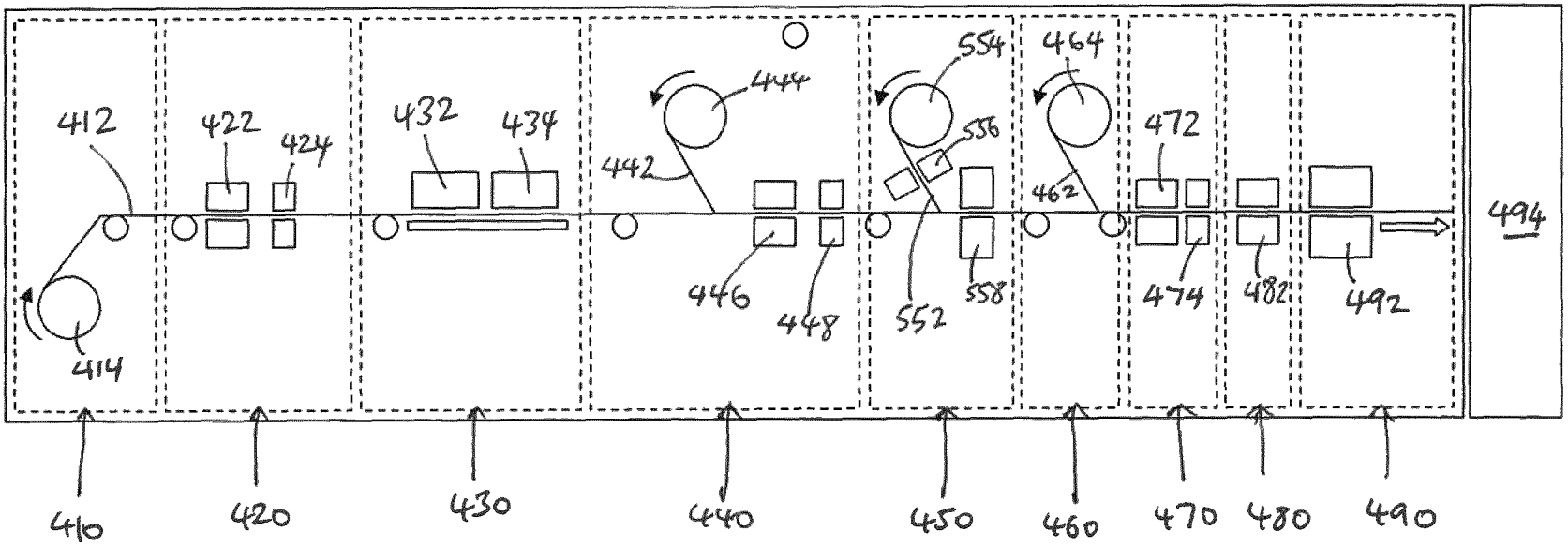
FIG. 4 shows a schematic illustration of a manufacturing process for making the aerosol-forming cartridge of FIGS. 2A and 2B in accordance with an embodiment of the present invention.
Figure 5:
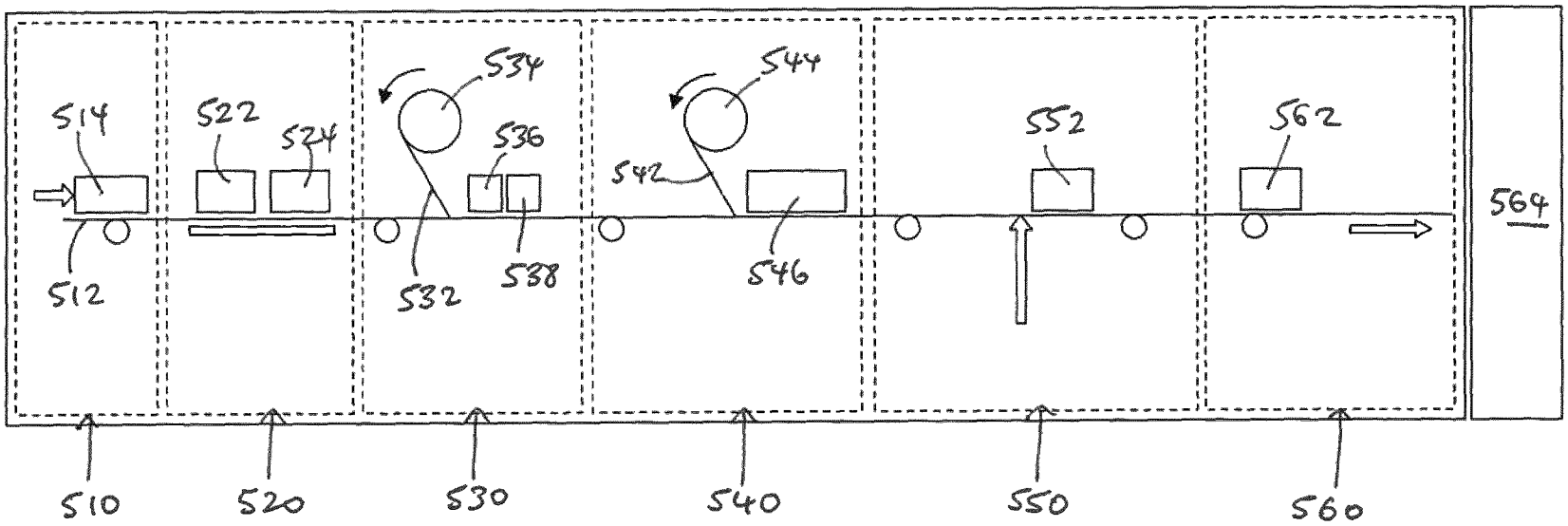
FIG. 5 shows a schematic illustration of a manufacturing process for making the aerosol-forming cartridge of FIGS. 3A and 3B in accordance with an embodiment of the present invention.

FIGS. 4 and 5 show schematic illustrations of manufacturing processes for making the aerosol-forming cartridges of FIGS. 2A, 2B and 3A, 3B. In both of the processes described, the cartridges are assembled "vertically" at a number of different stations along an assembly line as a stream of cartridge components is conveyed along the assembly line. The term "manufactured vertically", refers to the fact that the cartridge components are placed on each other in the vertical direction and in sequence to build the cartridge up as it travels along the conveyor, generally starting with the lowermost element and placing subsequent elements on top to end with the uppermost element of the cartridge. The contact surfaces between adjacent components are substantially planar and substantially parallel. With this approach, only vertical assembly operations are required. Thus, there is no need for any more complex assembly operations, such as rotational or multi-translational movements when forming the cartridges.

FIG. 4 shows a schematic illustration of a manufacturing process for making the aerosol-forming cartridge 220 of FIGS. 2A and 2B using an assembly line 400 having a number of different stations.

At a first station 410, a web of base layer foil 412 is fed from a bobbin 414 to the assembly line and is drawn along the length of the assembly line by a drive wheel (not shown). The web of base layer foil 412 may have a width that is several multiples of that of each completed cartridge so that multiple cartridges can be manufactured simultaneously.

At a second station 420, the web of base layer foil 412 is blistered to form the cavities 234 in each base layer 352. In this example, the base layer foil 412 is blistered using a vacuum thermoforming machine 422, although any suitable blister forming apparatus may be used. The contact apertures 240 in the base layer 222 are also formed at the second station 420 using first cutting device 424. In this example, the first cutting device 424 is a stamping die tool, although any suitable apparatus may be used. For example, the first cutting device 424 may instead be a rotary cutting tool.

At a third station 430, the porous carrier material of the aerosol-forming substrate 224 is fed to the base layer foil 412 and placed in the cavity 234 formed by the blister in the base layer 222 by a first automated placement device 432, such as a pick and place machine. The liquid substrate is then dispensed onto the porous carrier using an automated vertical dosing and filling apparatus 434.

At a fourth station 440, a web of electric heater foil 442 is fed from a bobbin 444 to the base layer foil 412 and is welded to the base layer foil 412 by a first automated ultrasonic welding device 446. In this example, the web of electric heater foil 442 comprises an electrically insulating substrate 237 on which a heating element 236 and electrical contacts 240 are disposed for each cartridge. When feeding the electric heater foil 442 to the base layer foil 412, the electric heater foil 442 is positioned so that the electrical contacts 238 are in line with the contact apertures 240 in the base layer foil 412. Once the heater foil 442 has been attached to the base layer foil 412, both layers are cut by a second cutting device 448 to form a window between successive cartridges. Each window has a width of less than that of an individual cartridge, so that the base layer foil 412 and the heater foil 442 remain held together by the sections of foil either side of each window. The windows are cut to form the downstream and upstream end shapes of the base layer 222 of each cartridge. Each window has a width of greater than that of the protective foil so that the remaining material between adjacent windows can be cut after the application of the protective foil without damaging the protective foil. If the windows were not cut until after the protective foil had been applied, it would be difficult to cut between adjacent cartridges without damaging the protective foil. In embodiments of cartridge which do not comprise a protective foil, the cutting of such windows is not required. In this example, the second cutting device 448 is a stamping die tool, although any suitable apparatus may be used. For example, the second cutting device 448 may instead be a rotary cutting tool.

At a fifth station 450, a web of protective foil 452 is fed from a bobbin 454 to a third cutting device 456. The third cutting device 456 applies cut lines to the web of protective foil 452 so that individual protective foils 230 can be separated from the web of protective foil 452. The individual protective foil 230 is applied over the heater foil 442 so that the tab 248 extends in the opposite direction to that of the assembled cartridge, that is, in the direction of the end of the cartridge 220 at which the electrical contacts 240 are located. The protective foil is removably attached to the cover layer by ultrasonic welding to form a continuous sealing line 231 around the opening 236 in the electrically insulating substrate 237 of the heater 226 and the protective foil is then folded back on itself along a transverse fold line 249 so that the tab extends beyond the heater 226 in the direction shown in FIG. 2A. The cutting, welding and folding steps can be carried out by a single machine 458 or by two or more separate devices.

At a sixth station 460, a web of top cover foil 462 is fed from a bobbin 464 to the assembly line and is drawn along the length of the assembly line by a drive wheel (not shown). The web of top cover foil 462 may have a width that is several multiples of that of each completed cartridge so that multiple cartridges can be manufactured simultaneously.

At a seventh station 470, the web of top cover foil 462 is blistered to form the air flow channel in each cartridge 220. In this example, the top cover foil 462 is blistered using a vacuum thermoforming machine 472, although any suitable blister forming apparatus may be used. Similarly to the cutting step at the fourth station 440, the top cover foil 462 is cut by a third cutting device 474 to form a window in the top cover foil 462 between successive cartridges. Each window has a width of less than that of an individual cartridge, so that the top cover foil 462 remains held together by the sections of foil either side of each window. The dimensions of the windows in the top cover foil 462 are generally the same as those of the windows cut in the base layer foil at the fourth station 440. The windows are cut to form the downstream and upstream end shapes of the top cover layers 232 of each cartridge. In this example, the third cutting device 474 is a stamping die tool, although any suitable apparatus may be used. For example, the third cutting device 474 may instead be a rotary cutting tool.

At an eighth station 480, the top cover foil 462 is welded to the base layer foil using a second automated ultrasonic welding device 482.

At a ninth station 490, individual assembled cartridges are cut to their final shape and size from the remaining foil by a fourth cutting device 492 to complete the assembly process.

The completed cartridge 220 is then conveyed to a packer 494, where it is combined with other completed cartridges and packaged for sale.

FIG. 5 shows a schematic illustration of a manufacturing process for making the aerosol-forming cartridge 320 of FIGS. 3A and 3B using an assembly line 500 having a number of different stations.

At a first station 510, individual, injection-moulded base layers 322 are fed onto a conveyor 512 by a first automated placement device 514, such as a pick and place machine, as shown by the arrow. The conveyor 512 is a continuous belt with a plurality of cavities (not shown) on its top surface for receiving the base layers and ensuring correct placement of the base layers on the conveyor 512. The cavities may be arranged in a grid and the first automated placement device 514 may be arranged to pick up and place a plurality of base layers in the cavities in one movement so that multiple cartridges can be produced simultaneously. The following description of the process refers to the manufacture of an individual cartridge, although it could apply to multiple cartridges.

At a second station 520, the first and second aerosol-forming substrates 324A, 324B are fed to the conveyor 512 and placed in the first and second cavities 334A, 334B on the top surface of the base layer 322 by a second automated placement device 522, such as a pick and place machine. In this example, the aerosol-forming substrates each comprise a solid substrate. In examples where one or both of the aerosol-forming substrates comprise a liquid substrate absorbed in a porous carrier, the porous carrier is first placed in the cavity by the second automated placement device 522 and the liquid substrate is then dispensed onto the porous carrier using an automated vertical dosing and filling apparatus (not shown).

At a third station 530, a web of electric heater foil 532 is fed from a bobbin 534 to the conveyor 512 and an individual electric heater 326 is cut from the web of foil by a cutting device 536 and placed in the cavity 334 on the top surface of the base layer by a third automated placement device 538. In this example, the web of electric heater foil 532 comprises an electrically insulating substrate 337 on which first and second heating elements 336A, 336B and electrical contacts 340 are disposed for each cartridge. During this step, the electric heater is placed so that its electrical contacts 338 are in line with the contact apertures 340 in the base layer.

At a fourth station 540, a web of protective foil 542 is fed from a bobbin 544 to the conveyor 512 and an individual protective foil 330 is cut from the web of protective foil 542. The protective foil 330 is applied over the heater 326 so that the tab 348 extends in the opposite direction to that of the assembled cartridge, that is, in the direction of the end of the cartridge 320 at which the electrical contacts 340 are located. The protective foil is removably attached to the heater 326 by ultrasonic welding to form a continuous sealing line 331 around the first and second openings 339A, 339B in the electrically insulating substrate 337 and the protective foil is then folded back on itself along a transverse fold line 349 so that the tab extends beyond the cover layer in the direction shown in FIG. 3B. The cutting, welding and folding steps can be carried out by a single machine 546 or by two or more separate devices.

At a fifth station 550, an injection-moulded top cover 332 is fed, as shown by the arrow, to the conveyor 512 by a fifth automated placement device 552, such as a pick and place machine.

At a sixth station 560, the top cover 332 is welded to the base layer 322 by a second automated ultrasonic welding device 562 to complete the assembly of the cartridge. The completed cartridge is then conveyed to a packer 564, where it is combined with other completed cartridges and packaged for sale. Optionally, prior to conveying the completed cartridge to the packer 564, the cartridge may be wrapped with a paper, multi-layer paper, or multi-layer polymeric foil outer wrapper, using a conventional wrapping apparatus.

In each of the above described processes, any two or more of the foil webs may be indexed to ensure precise relative positioning of the various components of each cartridge. For example, the foil webs may have perforated edges by which they are indexed.

The exemplary embodiments described above illustrate but are not limiting. In view of the above discussed exemplary embodiments, other embodiments consistent with the above exemplary embodiments will now be apparent to one of ordinary skill in the art.

The invention claimed is:

1. An aerosol-forming cartridge for an electrically operated aerosol-generating system, the cartridge comprising:
- a base layer;
- at least one aerosol-forming substrate disposed on the base layer and comprising a liquid nicotine source; and
- an electric heater including at least one heating element configured to heat the at least one aerosol-forming substrate,
- wherein the base layer and the at least one aerosol-forming substrate are in contact at a contact surface that is substantially planar,
- wherein a contact surface between the electric heater and the at least one aerosol-forming substrate is substantially planar and substantially parallel to the contact surface between the base layer and the at least one aerosol-forming substrate, and
- wherein the at least one heating element is positioned on an opposite side of the at least one aerosol-forming substrate to the base layer.

2. The aerosol-forming cartridge of claim 1, wherein one or both of the base layer and the at least one aerosol-forming substrate is substantially flat.

3. The aerosol-forming cartridge of claim 1,
- wherein the base layer comprises at least one cavity, and
- wherein the at least one aerosol-forming substrate is held in the at least one cavity.

4. The aerosol-forming cartridge of claim 1, wherein the at least one aerosol-forming substrate further comprises a plurality of aerosol-forming substrates arranged separately on the base layer.

5. The aerosol-forming cartridge of claim 4,
- wherein the base layer comprises a plurality of cavities, and
- wherein each of the plurality of aerosol-forming substrates is held in one of the plurality of cavities.

6. The aerosol-forming cartridge of claim 1,
- wherein the at least one aerosol-forming substrate comprises a plurality of aerosol-forming substrates arranged separately on the base layer, and
- wherein the electric heater comprises a plurality of heating elements each configured to heat a different one of the plurality of aerosol-forming substrates.

7. The aerosol-forming cartridge of claim 1, wherein the cartridge further comprises an integral mouthpiece portion.

8. The aerosol-forming cartridge of claim 7, wherein the cartridge is configured such that a resistance to draw at a downstream end of the integral mouthpiece portion is from about 50 mmWG to about 130 mmWG.

9. An electrically operated aerosol-forming system comprising an aerosol-generating device and an aerosol-forming cartridge,
- aerosol-forming cartridge comprising:
  - a base layer;
  - at least one aerosol-forming substrate disposed on the base layer and comprising a liquid nicotine source; and
  - an electric heater including at least one heating element configured to heat the at least one aerosol-forming substrate,
  - wherein the base layer and the at least one aerosol-forming substrate are in contact at a contact surface that is substantially planar,
  - wherein a contact surface between the electric heater and the at least one aerosol-forming substrate is substantially planar and substantially parallel to the contact surface between the base layer and the at least one aerosol-forming substrate, and
  - wherein the at least one heating element is positioned on an opposite side of the at least one aerosol-forming substrate to the base layer; and
- the device comprising:
  - a main body defining a slot-shaped receptacle, the aerosol-forming cartridge being removably receivable within the slot-shaped receptacle; and
  - an electric power supply configured to supply power to the electric heater.

10. A method of manufacturing an aerosol-forming cartridge for an electrically operated aerosol-generating system, the method comprising:
- providing a base layer;
- placing at least one aerosol-forming substrate on the base layer such that the base layer and the at least one aerosol-forming substrate are joined at a contact surface that is substantially planar, wherein the aerosol-forming substrate comprises a liquid nicotine source; and
- attaching an electric heater comprising at least one heating element to the base layer such that the electric heater and the base layer are in contact at a contact surface that is substantially planar and is substantially parallel to the contact surface between the base layer and the at least one aerosol-forming substrate, and such that the at least one heating element is positioned on an opposite side of the at least one aerosol-forming substrate to the base layer.

11. The method of claim 10, further comprising forming at least one cavity in the base layer, wherein the placing the at least one aerosol-forming substrate on the base layer is performed by placing the at least one aerosol-forming substrate in the at least one cavity.

12. The method of claim 10, wherein the attaching the electric heater is performed by feeding a web of electric heater foil from a bobbin to an assembly line and cutting the web of electric heater foil transversely to form individual electric heaters.

13. The method of claim 12, wherein the web of electric heater foil comprises a web of electrically insulating substrate foil to which a plurality of heating elements is attached.

14. The method of claim 10, wherein the providing the base layer comprises feeding a web of base layer foil from a bobbin to an assembly line and cutting the web of base layer foil transversely to form individual base layers.

15. The method of claim 12, wherein the web of electric heater foil has a width that is greater than that of the cartridge, and wherein a plurality of aerosol-forming cartridges are made in parallel.

16. The method of claim 14, wherein the web of base layer foil has a width that is greater than that of the cartridge, and wherein a plurality of aerosol-forming cartridges are made in parallel.

17. The method of claim 12, wherein two or more webs of foil from which the cartridge is made are laminated together.

18. The method of claim 14, wherein two or more webs of foil from which the cartridge is made are laminated together.

19. The aerosol-forming cartridge of claim 7, wherein the cartridge is configured such that a resistance to draw at a downstream end of the integral mouthpiece portion is from about 95 mmWG to about 105 mmWG.

20. The method of claim 12, wherein the web of electric heater foil has a width that is from about two times to about 50 times greater than the width of the cartridge, and wherein a plurality of aerosol-forming cartridges are made in parallel.

21. The method of claim 14, wherein the web of base layer foil has a width that is from about two times to about 50 times greater than the width of the cartridge, and wherein a plurality of aerosol-forming cartridges are made in parallel.

* * * * *